US011125441B2

(12) United States Patent
Saubert et al.

(10) Patent No.: US 11,125,441 B2
(45) Date of Patent: Sep. 21, 2021

(54) HEATING DEVICE

(71) Applicant: TRANSFORM SR BRANDS LLC, Hoffman Estates, IL (US)

(72) Inventors: Michael Saubert, Hoffman Estates, IL (US); Elvin Bautista, Hoffman Estates, IL (US); Salameh Alsweis, Hoffman Estates, IL (US); Thaddeus J. Lepucki, Hoffman Estates, IL (US)

(73) Assignee: Transform SR Brands LLC, Hoffman Estates, IL (US)

( * ) Notice: Subject to any disclaimer, the term of this patent is extended or adjusted under 35 U.S.C. 154(b) by 221 days.

(21) Appl. No.: 16/208,364

(22) Filed: Dec. 3, 2018

(65) Prior Publication Data

US 2019/0170359 A1 Jun. 6, 2019

Related U.S. Application Data

(60) Provisional application No. 62/593,593, filed on Dec. 1, 2017.

(51) Int. Cl.

| | |
|---|---|
| ***F24C 3/14*** | (2006.01) |
| ***F24C 3/12*** | (2006.01) |
| ***F24C 3/10*** | (2006.01) |
| ***F24C 15/24*** | (2006.01) |
| ***H05B 3/42*** | (2006.01) |
| *F24C 3/04* | (2006.01) |
| *F24C 3/08* | (2006.01) |

(52) U.S. Cl.

CPC ..... *F24C 3/122* (2013.01); *F24C 3/103* (2013.01); *F24C 3/14* (2013.01); *F24C 15/24* (2013.01); *H05B 3/42* (2013.01); *F24C 3/042* (2013.01); *F24C 3/082* (2013.01); *H05B 2203/032* (2013.01)

(58) Field of Classification Search

CPC .. F24C 3/122; F24C 3/103; F24C 3/14; F24C 15/24; F24C 3/042; F24C 3/082; H05B 3/42; H05B 2203/032

See application file for complete search history.

(56) References Cited

U.S. PATENT DOCUMENTS

| | | | | |
|---|---|---|---|---|
| 3,307,529 A * | 3/1967 | Fannon, Jr. | F24C 1/10 | 126/92 B |
| 5,270,519 A * | 12/1993 | Higgins | F24C 15/106 | 219/448.19 |
| 6,018,149 A * | 1/2000 | Higgins | H05B 1/0266 | 219/443.1 |
| 6,452,135 B1 * | 9/2002 | Johnson, III | F24C 7/088 | 219/388 |

(Continued)

*Primary Examiner* — Alfred Basichas

(74) *Attorney, Agent, or Firm* — McAndrews, Held & Malloy, Ltd.

(57) ABSTRACT

Systems and methods for radiative heat transfer are disclosed. In an exemplary embodiment, an infrared heater comprises infrared heating elements and a controller. The infrared heating elements correspond to respective heating zones. The controller causes the infrared heating elements to turn on at different time in succession such that respective heating zones are radiatively heated at different times. In some instances, the respective heating zones correspond to different heating zones of a user, and the user feels a heating wave effect as the infrared heating elements are turned on and off at different times.

18 Claims, 5 Drawing Sheets

(56) References Cited

U.S. PATENT DOCUMENTS

| | | | | |
|---|---|---|---|---|
| 2004/0100131 | A1* | 5/2004 | Howick | B60N 2/002 297/180.12 |
| 2004/0177843 | A1* | 9/2004 | Bernini | F24C 1/12 126/92 AC |
| 2011/0108015 | A1* | 5/2011 | Jamieson | F24H 9/2085 126/116 A |
| 2012/0304980 | A1* | 12/2012 | Dettloff | F24C 3/085 126/39 E |
| 2013/0104878 | A1* | 5/2013 | Jin | F24C 3/14 126/92 AC |

* cited by examiner

HEATING DEVICE

RELATED APPLICATIONS/INCORPORATION BY REFERENCE

The present application claims benefit from and priority to U.S. Application No. 62/593,593, filed Dec. 1, 2017. The above-identified application is hereby incorporated herein by reference in its entirety.

FIELD OF THE DISCLOSURE

Certain embodiments of the disclosure relate to systems and methods for providing radiative heat transfer and, in particular, infrared radiative heat transfer.

BACKGROUND OF THE DISCLOSURE

A conventional heater warms the air through convective heat transfer. Convective heat transfer can be a slow heating process for a particular space. Further, the environment suffers from noise due to the requirement of a fan to move the air over a heating element to effect convective heat transfer.

Further limitations and disadvantages of conventional and traditional approaches will become apparent to one of skill in the art, through comparison of such systems with the present disclosure as set forth in the remainder of the present application with reference to the drawings.

BRIEF SUMMARY OF THE DISCLOSURE

Systems, devices, and methods for providing radiative heat transfer are provided substantially as illustrated by and/or described in connection with at least one of the figures, as set forth more completely in the claims.

Various advantages, aspects and novel features of the present disclosure, as well as details of an illustrated embodiment thereof, will be more fully understood from the following description and drawings.

DETAILED DESCRIPTION OF THE DISCLOSURE

Figure 1:
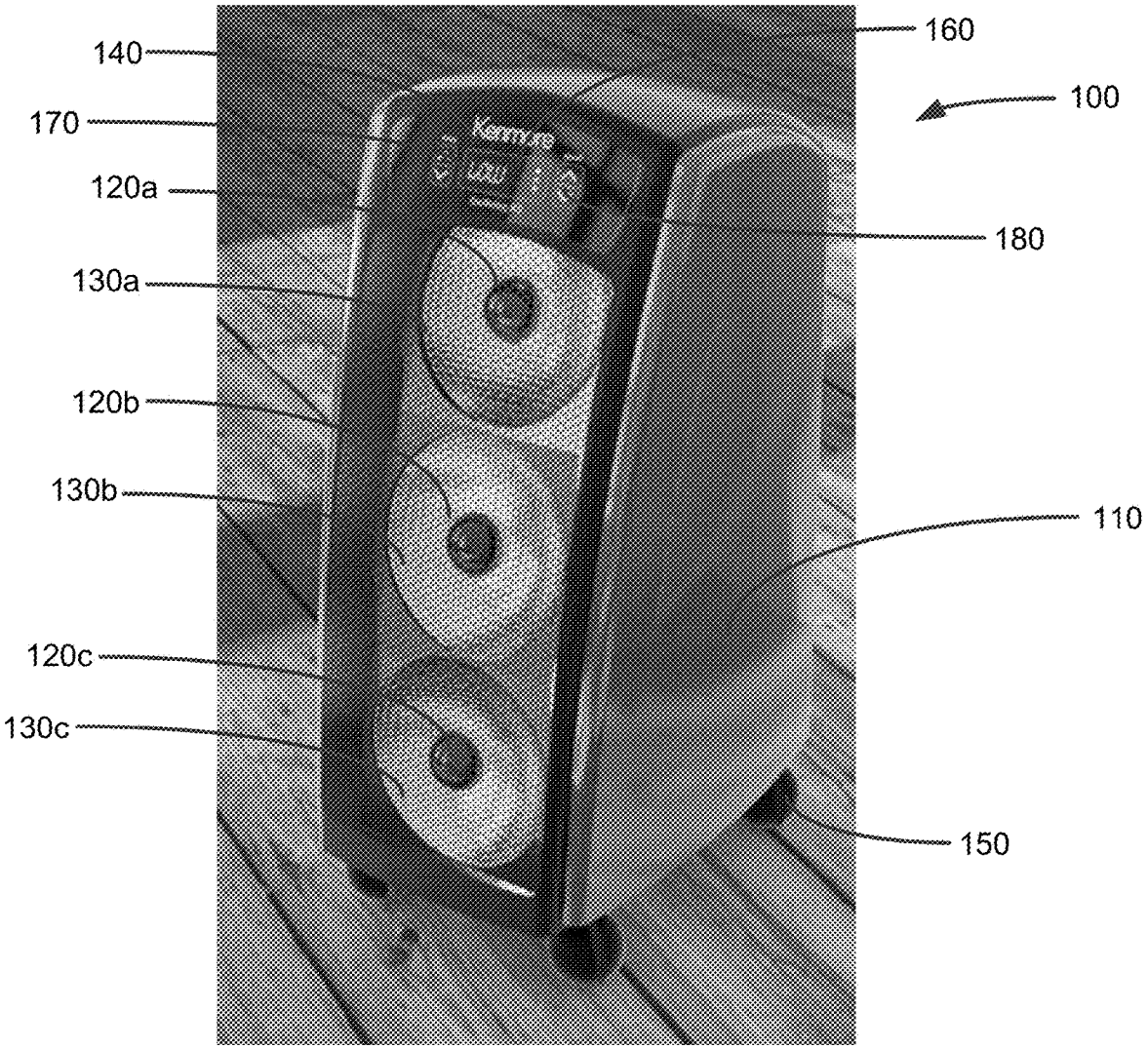
FIG. 1 shows a first embodiment of an infrared heater according to the present disclosure.

As utilized herein the terms "circuit" and "circuitry" refer to physical electronic components (i.e., hardware) and any software and/or firmware ("code") which may configure the hardware, be executed by the hardware, and/or otherwise be associated with the hardware. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g." and "for example" set off lists of one or more non-limiting examples, instances, or illustrations.

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated.

Some embodiments of the present disclosure relate to systems, methods, and devices for providing radiative heat transfer such as infrared radiative heat transfer, for example.

Some embodiments of the present disclosure provide an infrared heater that includes, for example, a plurality of infrared heating elements. In some embodiments, the plurality of infrared heating elements form an infrared element array. The infrared heater can be configured such that each infrared heating element can heat a respective heating zone. These heating zones can overlap. In some embodiments, each heating element can also work in combination with one or more reflectors or reflecting panels (e.g., reflectors, metal reflectors, reflecting panels, metal reflecting panels, mirrors, lenses, etc.) that guide or focus the infrared radiation generated by the corresponding heating element in a particular direction or into a particular zone.

Some embodiments of the present disclosure provide that the infrared heating elements can be pulsed so that a different one or a different subset of the infrared heating elements is on at a particular time. Some embodiments provide that different ones or different subsets of the infrared heating elements can overlap in time with respect to when they are on. In some embodiments, the amount of time that a particular one or a particular subset of the infrared heating elements is on and off can be set or programmed for a particular pattern, thereby adjusting the pulsed effect or wave effect generated by the infrared heating elements. Further, one or more of the infrared heating elements can be set to be on while the other infrared heating elements are pulsed on and off.

Some embodiments of the present disclosure provide a heater that uses electromagnetic radiation (e.g., infrared radiation, visible light radiation, ultraviolet radiation, radio frequency radiation, etc.). Accordingly, the radiated heat is felt almost immediately in comparison with convective heat transfer. In addition, the electromagnetic radiation heater provides the heat or energy more efficiently and more directly than convective heaters. Further, a heater that uses electromagnetic radiation is quieter in comparison with a convective heater that employs a fan, for example. In some embodiments, the electromagnetic radiation heater has no moving mechanical parts to effect heat transfer during operation.

Some embodiments of the present disclosure provide a heater that provides a particular glow (e.g., color, intensity, etc.) by using electromagnetic radiation, thereby enhancing the visual appeal of an environment. For example, the heater can be set up to provide a warm glow or a fireplace glow. In another example, the heater can be set up to an exposure that is similar to sunshine. In yet another example, the heater can be set up to provide a pulsing light effect that can create an interesting lighting and heating effect on the user and/or the environment. The heater can employ one or more types of electromagnetic radiation to enhance the visual appeal of the environment. For example, the heater may include visible lighting elements that are used to create a particular mood in a room. In yet another embodiment, the heater can employ different portions of the electromagnetic spectrum to access correspondingly different frequency energies to effect respectively different outputs in energy, heat, and/or lighting.

Some embodiments of the present disclosure provide a heater that can be used for personal use. For example, the heater can be placed on the ground (e.g., on wheels or legs) and positioned to face a user who is sitting or reclining in a chair at a home or office.

FIG. 1 shows an embodiment of an infrared heater 100 according to the present disclosure. Referring to FIG. 1, the infrared heater 100 includes, for example, a housing 110, infrared heating elements 120*a-c*, infrared reflectors 130*a-c*, a control panel 140, and wheels (or feet) 150. Although illustrated in FIG. 1 as a spherical infrared heating element such as an infrared light bulb or an infrared heating coil in a spherical casing, for example, different shapes and types of infrared heating elements 120 are also contemplated and fall within the scope of the disclosure. Although shown with three infrared heating elements 120*a-c*, the infrared heater 100 can have more or less than three infrared heating elements 120. The housing 110 is configured to rest on the wheels (or feet) 150, and is configured to house the infrared heating elements 120*a-c* that are controlled by the control panel 140. The infrared reflectors 130*a-c* are configured to reflect and/or guide the infrared radiation in a particular direction and/or towards a particular zone for heating. Although illustrated in FIG. 1 as an infrared reflecting disk, different shapes and types of infrared reflectors 130 are also contemplated and fall within the scope of the disclosure. The infrared heating elements 120*a-c* and/or the infrared reflectors 130*a-c* can be configured to be aimed in a particular direction and/or towards a particular zone for heating. The aim can be effected by moving one or both of the infrared heating elements 120*a-c* and/or the infrared reflectors 130*a-c*. The aim can also be effected via constructive and/or destructive radiation patterns in time and/or space.

The control panel 140 can include, for example, a user interface 160 with a display 170 (e.g., a graphical display, a screen, a touch-sensitive display, a liquid crystal display (LCD), a light emitting diode (LED) display, an organic LED (OLED) display, etc.) and one or more user inputs 180. In some embodiments, the user interface 160 can include, for example, a graphical user interface that has one or more graphical elements instead of or in addition to physical user inputs (e.g., buttons, knobs, switches, etc.) that can be used to control the infrared heater 100. The graphical elements can be selected via touch-sensitive display and/or a user input device (e.g., a wireless user input device, a mouse, a keyboard, a remote control, an application running on a user device such as a laptop, a smartphone, a tablet, etc.).

In operation according to some embodiments, the user inputs 180 are actuated (e.g., buttons are pushed, knobs are rotated, graphical elements on a graphical user interface are selected) to cause the infrared heater 100 to turn on. The user inputs 180 can be used to set up the infrared heater 100. The user inputs 180 can be also used to control the heat intensity and/or output of the infrared heating elements 120*a-c*; the frequency and/or duty cycle of the pulsing of the infrared heating elements 120*a-c*; the maximum and/or minimum power settings of the infrared heating elements 120*a-c*; the angle of inclination and/or declination of one or both of the infrared heating elements 120*a-c* and the infrared reflectors 130*a-c*; the infrared heating elements 120*a-c* that participate in the pulsing; and the infrared heating elements 120*a-c* that do not participate in the pulsing (e.g., are statically on or off without pulsing). The user inputs 180 can be used to select or program a particular pulse pattern. Further, the user inputs 180 can be used to set up a clock; a timer that controls the amount of time (e.g., a time duration, a starting time, a stopping time, etc.) that the infrared heating elements 120*a-c* are pulsing and/or are on; a timer that controls the amount of time that the infrared heater 100 is on; and the pulse pattern. Finally, the user input 180 can be used to begin operation of the infrared heater 100 based on the input or stored settings.

Figure 2:
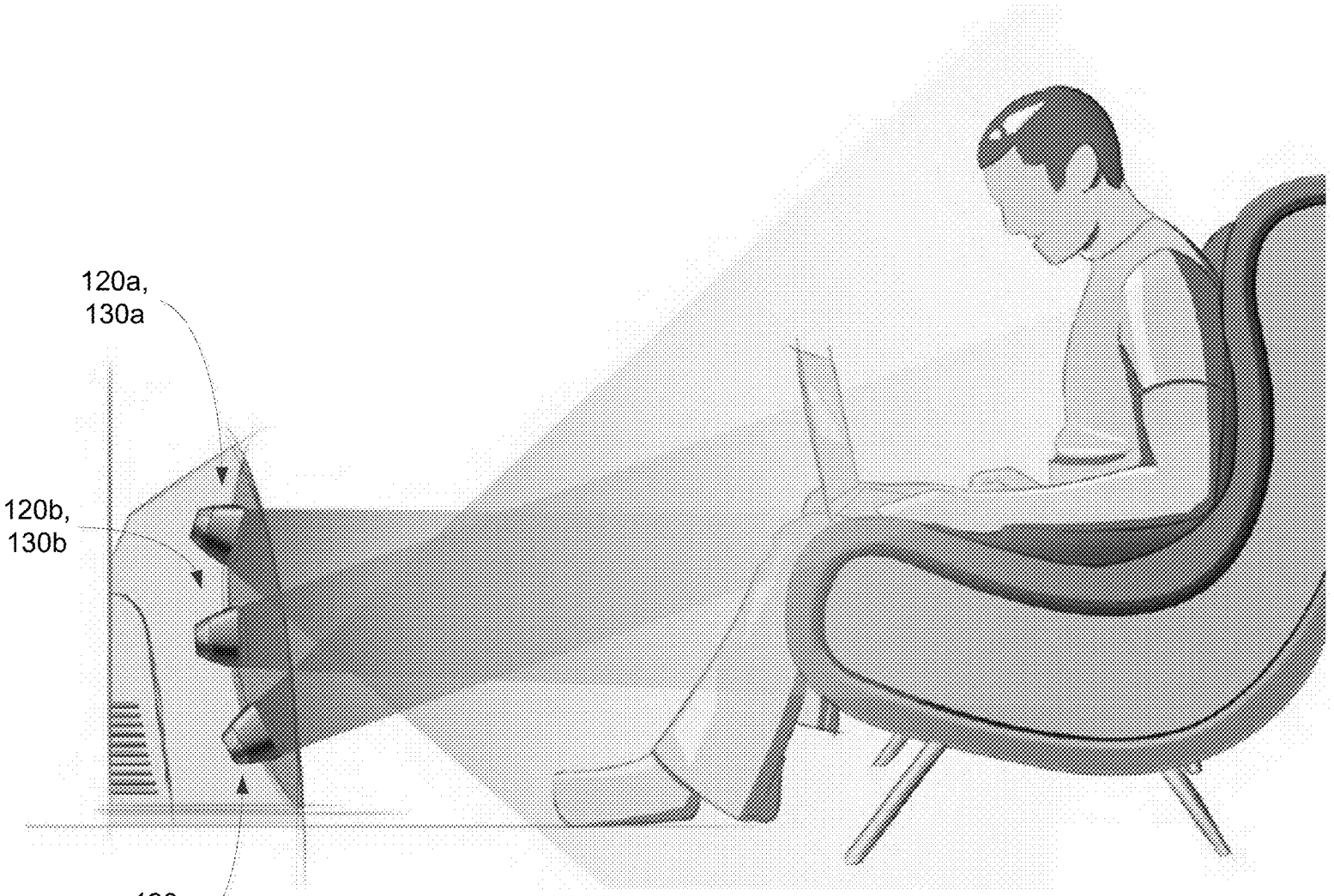
FIG. 2 shows an operation of the infrared heater illustrated in FIG. 1 according to an embodiment of the present disclosure.
Figure 3A:
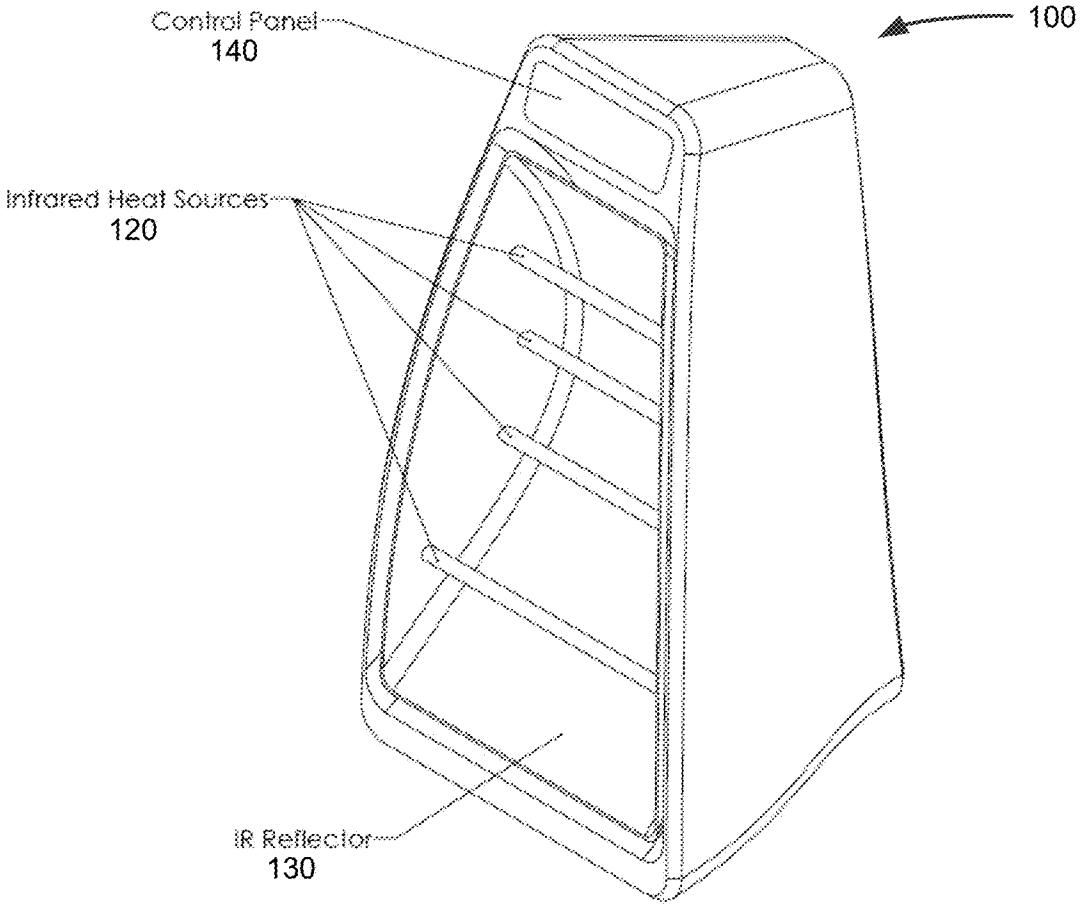
FIG. 3A shows a perspective view of a second embodiment of the infrared heater according to the present disclosure.
Figure 3B:
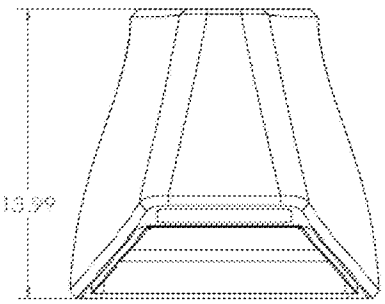
FIG. 3B shows a top view of the second embodiment of the infrared heater according to the present disclosure.
Figure 3C:
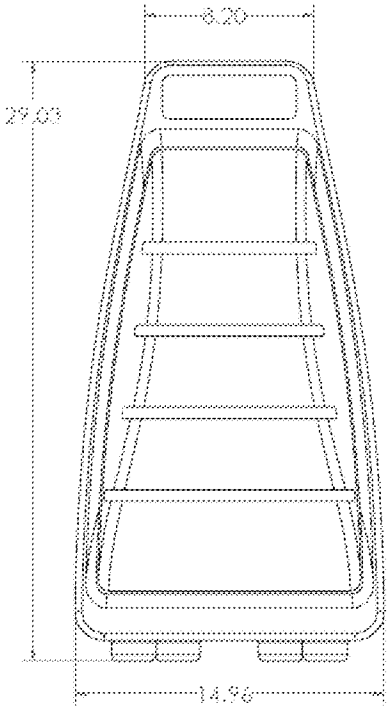
FIG. 3C shows a front view of the second embodiment of the infrared heater according to the present disclosure.
Figure 3D:
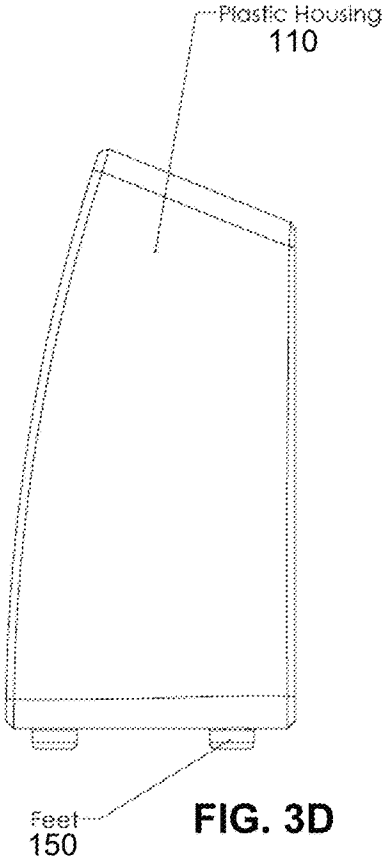
FIG. 3D shows a side view of the second embodiment of the infrared heater according to the present disclosure.

The infrared heater 100 can operate in a number of modes based on the settings. For example, the infrared heater 100 is shown with three infrared heating elements 120*a-c*. The infrared heater 100 can be operated so that three or less of the infrared heating elements 120*a-c* are continuously or periodically on. For example, the infrared heater 100 can be operated so that one of the infrared heating elements 120*a-c* is on. If the user wants to warm the user's feet, the user might set up the infrared heater 100 so that only one infrared heating element depending on the angle of the infrared heating element, for example, is continuously on. If the user wants to warm the user's entire body, the user might set up the infrared heater 100 so that all three infrared heating elements 120*a-c* are used. FIG. 2 shows an embodiment of the infrared heater 100 in which all three heating elements 120*a-c* are used. The angle of inclination or declination of the three infrared heating elements, which can be static or can be set by the user inputs 180, determines the particular direction of the infrared radiation and/or the particular zone being heated and/or irradiated by the infrared radiation. Some embodiments provide that the particular directions of the infrared radiation and/or the particular zones being heated and/or irradiated by the infrared radiation can overlap and/or can be set up to overlap.

Some embodiments provide that the infrared heater 100 can be pulsed and/or controlled to generate a heat wave effect. Referring to FIG. 2, for example, the infrared heating elements 120*a-c* can be turned on and off according to a particular frequency and/or pattern. In some embodiments, the infrared heating element 120*a* can be turned on (e.g., be in an on state or a high and/or increased power state) for a first period of time to warm up a lower portion of the user. During the first period of time, the infrared heating elements 120*b-c* can remain off (e.g., be in an off state or a low and/or reduced power state). In a subsequent second period, the infrared heating element 120*b* can be turned on to warm up a middle portion of the user. During the second period of time, the infrared heating elements 120*a* can be turned off and the infrared heating element 120*c* can remain off. In a subsequent third period, the infrared heating element 120*c* can be turned on to warm up an upper portion of the user. During the third period, the infrared heating element 120*b* can be turned off and the infrared heating element 120*a* can remain off. The process can continue repeatedly up and down the infrared heating elements 120*a-c*, or repeatedly restart from the top infrared heating element 120*a*. Some embodiments contemplate that the infrared heating elements 120*a-c* can be overlap in being on at the same time. Thus, for example, in the transition from the first period of time to the second period of time, the infrared heating element 120*a* can remain on for a first portion of the subsequent second period of time such that the infrared heating elements 120*a-b* are on at the same time for the first portion of the second period of time.

FIGS. 3A-D show different views of another embodiment of the infrared heater 100 according to the present disclosure. Referring to FIGS. 3A-D, the infrared heating elements 120 are elongated and extend substantially from one side of the housing 110 to the other side of the housing 110. The heating elements 120 can be attached to the sides of the housing 110 or can be attached to rails that extend up and down the housing 110. Although illustrated as bars, rods, or tubes, different shapes and types of infrared heating elements 120 are also contemplated and fall within the scope of the disclosure. A single infrared reflector 130 is configured to guide and/or reflect the infrared radiation from the infrared heating elements 120. Although illustrated as a single infrared reflector 130, using more than one infrared reflector 130 is also contemplated and falls within the scope of the disclosure. In some embodiments, the single infrared reflector 130 is curved so that the infrared radiation from the heating elements 120 are guided and/or reflected in respective directions and/or towards respective zones for heating.

Figure 4:
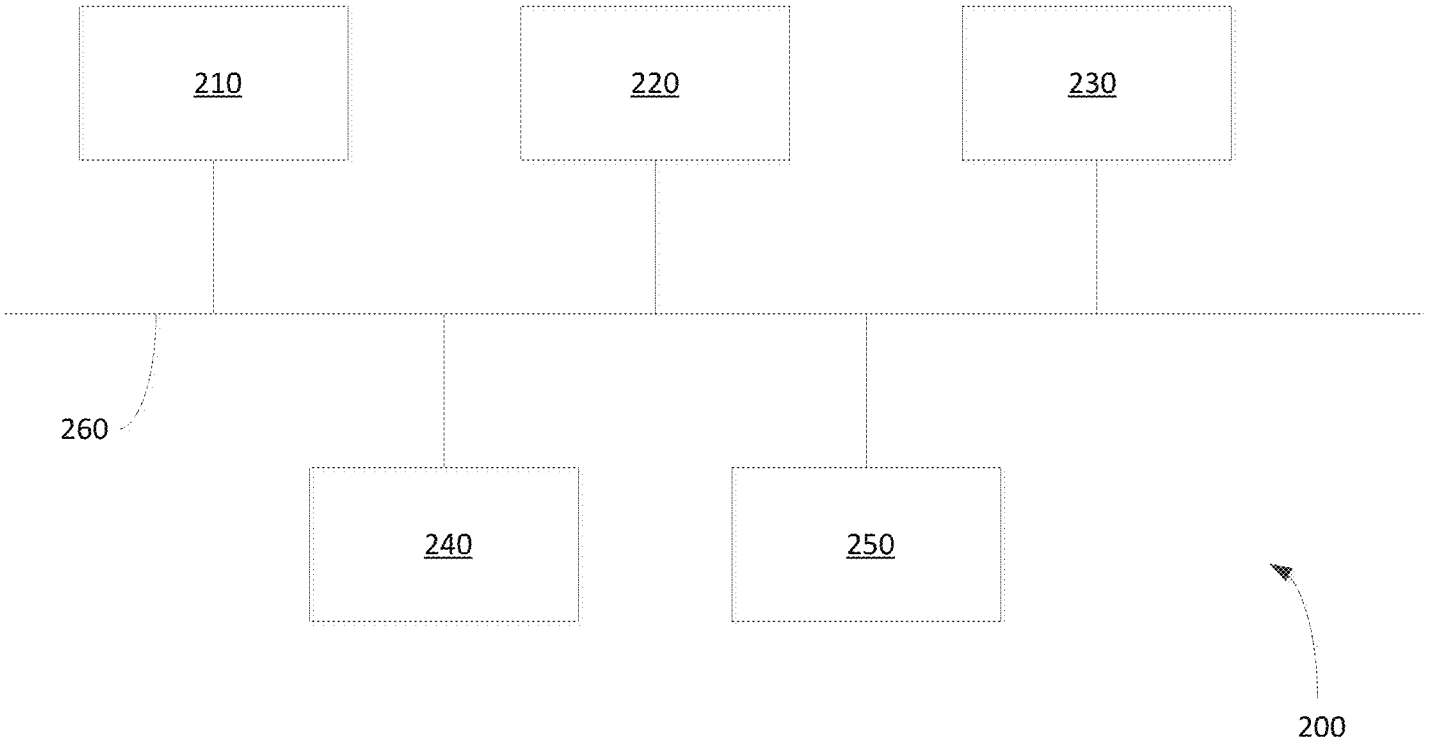
FIG. 4 shows an embodiment of one or more circuits of the infrared heater according to the present disclosure.

FIG. 4 shows an embodiment of one or more circuits 200 (e.g., component arrangement, device arrangement, and/or circuit arrangement) of the infrared heater 100 according to the present disclosure. The one or more circuits 200 illustrated in FIG. 4 are not comprehensive and can be supplemented with other components, devices, and/or circuits.

In some embodiments, the one or more circuits 200 can include, for example, one or more processors 210, one or more memories 220 (e.g., one or more nontransitory memories), one or more communication devices 230 (e.g., wireless adapters, wireless cards, cable adapters, wire adapters, dongles, radio frequency (RF) devices, wireless communication devices, Bluetooth devices, IEEE 802.11-compliant devices, WiFi devices, cellular devices, GPS devices, Ethernet ports, network ports, Lightning cable ports, cable ports, etc.), one or more input devices 240 (e.g., keyboards, mouse, touch pad, touch-sensitive screen, touch screen, pressure-sensitive screen, graphical user interface, user interfaces, buttons, microphone, etc.), and one or more output devices 250 (e.g., displays, screens, speakers, projectors, etc.). The processor 210, the memory 220, the communication device 230, the input device 240, and/or the output device 250 can be connected to one or more buses 260 or other types of communication links (e.g., wired and/or wireless links).

The processor 210 can include, for example, one or more of the following: a general processor, a central processing unit, a digital filter, a microprocessor, a digital processor, a digital signal processor, a microcontroller, a programmable array logic device, a complex programmable logic device, a field-programmable gate array, an application specific integrated circuit, one or more cloud or network servers operating in series or in parallel, and a memory. Code, instructions (e.g., processor-executable instructions), software, firmware and/or data may be stored in the processor 210, the memory 220, or both.

The memory 220 can include, for example, one or more of the following: a non-transitory memory, a non-transitory processor readable medium, a non-transitory computer readable medium, read only memory (ROM), random access memory (RAM), non-volatile memory, dynamic RAM (DRAM), volatile memory, erasable programmable ROM (EPROM), electrically EPROM (EEPROM), ferroelectric RAM (FRAM), first-in-first-out (FIFO) memory, last-in-first-out (LIFO) memory, stack memory, non-volatile RAM (NVRAM), static RAM (SRAM), a cache, a buffer, a semiconductor memory, a magnetic memory, an optical memory, a flash memory, a flash card, a compact flash card, memory cards, secure digital memory cards, a microcard, a minicard, an expansion card, a smart card, a memory stick, a multimedia card, a picture card, flash storage, a subscriber identity module (SIM) card, a hard drive (HDD), a solid state drive (SSD), etc. The memory 220 can be configured to store code, instructions, applications, software, firmware and/or data for use by the processor 210 and may be external, internal, or both with respect to the processor 210.

In some embodiments, some of the code, instructions, applications, software, firmware and/or data can be hardwired (e.g., hardware implementations, hardwired into registers, etc.) and/or can be programmable.

In some embodiments, some or all of the steps, acts, methods, and/or processes described herein can be performed by code, software, firmware, and/or instructions, for example, that are executed by the processor 210 and stored in the memory 220 of infrared heater 100.

In some embodiments, the one or more circuits 200 can be found in a user device (e.g., a remote control, a smartphone, a laptop, a tablet, a computer, a fob, etc.) that can be used to control, input data into, receive data from, and/or communicate with the infrared heater 100. In some embodiments, some or all of the steps, acts, methods, and/or processes described herein can be performed by code, software, firmware, and/or instructions, for example, that are executed by the processor 210 and stored in the memory 220 of the user device and/or the infrared heater 100.

Other embodiments of the present disclosure may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps as described herein for a reflection coefficient reader.

Accordingly, aspects of the present disclosure may be realized in hardware, software, or a combination of hardware and software. The present disclosure may be realized in a centralized fashion in at least one computer system or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

Aspects of the present disclosure may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. An infrared heater, comprising:

infrared heating elements corresponding to respective heating zones;

an infrared reflector that reflects infrared radiation from the infrared heating elements to the respective heating zones; and a controller operatively coupled to the infrared heating elements, wherein:

the controller causes the infrared heating elements to turn on at different times in succession such that respective heating zones are radiatively heated at different times, a top infrared reflector of the plurality of infrared reflectors reflects infrared radiation to a bottom heating zone of a user, and a bottom infrared reflector of the plurality of infrared reflectors reflects infrared radiation to a top heating zone of the user.

2. The infrared heater according to claim 1, wherein the controller causes the infrared heating elements to turn on and off at different times such that respective heating zones of a user are radiatively heated at different times.

3. The infrared heater according to claim 1, wherein the controller causes the infrared heating elements to turn on and off at different times such that a wave effect is radiatively transmitted to the user.

4. The infrared heater according to claim 1, wherein the respective heating zones correspond to respective heating zones of the user, and wherein at least some of the respective heating zones overlap.

5. The infrared heater according to claim 1, wherein a first heating element is turned on during a first time period of a heating cycle and a second heating element is turned off during the first time period, and wherein the first heating element is turned off during a second time period of the heating cycle and the second heating element is turned on during the second time period.

6. The infrared heater according to claim 5, wherein the second time period occurs immediately after the first time period.

7. The infrared heater according to claim 1, wherein two of the infrared heating elements can be on at the same time due to an overlap of on and off times of the two infrared heating elements.

8. The infrared heater according to claim 1, wherein the infrared reflector is a single infrared reflector.

9. The infrared heater according to claim 1, wherein the infrared reflector comprises a plurality of infrared reflectors, and wherein each infrared reflector corresponds to one of the infrared heating elements and reflects infrared radiation to the respective heating zone.

10. The infrared heater according to claim 1, comprising:

a user interface that is configured to receive control information for the infrared heater.

11. The infrared heater according to claim 1, comprising:

a wireless receiver that is configured to receive control signals for the infrared heater.

12. The infrared heater according to claim 1, comprising:

a wireless transceiver that is configured to enable wireless remote control of the infrared heater.

13. The infrared heater according to claim 1, wherein the controller is configured to cause the infrared heating elements to turn on and off in different heating patterns.

14. The infrared heater according to claim 1, comprising an other infrared heating element, wherein the controller can keep the other infrared heating element on while causing the infrared heating elements to turn on and off at different times in succession.

15. The infrared heater according to claim 1, wherein the infrared heating elements comprise infrared heating bars, infrared heating rods, or infrared heating tubes.

16. The infrared heater according to claim 1, wherein the infrared heating element is substantially shaped as a sphere.

17. The infrared heater according to claim 16, wherein each infrared heating element has a corresponding disk-shaped infrared reflector.

18. The infrared heater according to claim 1, comprising:

one or more visible light elements to light a room to create a particular mood.

* * * * *